US007861887B2

(12) United States Patent
Ota et al.

(10) Patent No.: US 7,861,887 B2
(45) Date of Patent: Jan. 4, 2011

(54) PRESSURE VESSEL

(75) Inventors: Masahiko Ota, Aichi-ken (JP); Motohiro Mizuno, Toyota (JP)

(73) Assignees: Toyoda Gosei Co., Ltd., Aichi-pref. (JP); Toyota Jidosha Kabushiki Kaisha, Toyota-shi (JP)

( * ) Notice: Subject to any disclaimer, the term of this patent is extended or adjusted under 35 U.S.C. 154(b) by 289 days.

(21) Appl. No.: 12/078,715

(22) Filed: Apr. 3, 2008

(65) Prior Publication Data

US 2008/0251520 A1 Oct. 16, 2008

(30) Foreign Application Priority Data

Apr. 6, 2007 (JP) ..... 2007-100831

(51) Int. Cl.
*F17C 1/02* (2006.01)

(52) U.S. Cl. ..... 220/581

(58) Field of Classification Search ..... 220/581, 220/582, 586, 588–590; 206/0.6
See application file for complete search history.

(56) References Cited

U.S. PATENT DOCUMENTS 5,518,141 A * 5/1996 Newhouse et al. ..... 220/586
5,938,209 A * 8/1999 Sirosh et al. ..... 277/622
6,186,356 B1 * 2/2001 Berkley et al. ..... 220/582
6,227,402 B1 * 5/2001 Shimojima et al. ..... 220/581

FOREIGN PATENT DOCUMENTS

| | | |
|---|---|---|
| JP | A-10-332085 | 12/1998 |
| JP | A-2000-291887 | 10/2000 |
| JP | A-2000-291888 | 10/2000 |
| JP | A-2001-050494 | 2/2001 |
| JP | A-2002-349796 | 12/2002 |
| JP | A-2004-211783 | 7/2004 |
| WO | WO 94/23240 | 10/1994 |

OTHER PUBLICATIONS

Office Action dated Feb. 10, 2009 in corresponding JP application No. 2007-100831.

* cited by examiner

*Primary Examiner*—Harry A Grosso
(74) *Attorney, Agent, or Firm*—Posz Law Group, PLC

(57) ABSTRACT

A pressure vessel capable of securely sealing a mouth ring with a liner portion, and being manufactured at low costs. A boss seal part 112 is provided in a liner portion 11 of the pressure vessel, and an inner peripheral surface of a boss part 20 of a mouth ring 2 is covered with the boss seal part 112. A boss-side collar part 114 is provided in the boss seal part 112 so as to project outwardly, and a sealing member 4 composed of a resilient body is disposed in a space between an inner peripheral surface of the boss seal part 112 and an outer peripheral surface of the valve 3.

4 Claims, 6 Drawing Sheets

PRESSURE VESSEL

This invention is based on Japanese Patent Application No. 2007-100,831, filed on Apr. 6, 2007, the entire contents of which are incorporated herein by reference.

BACKGROUND OF THE INVENTION

1. Field of the Invention

The present invention relates to a pressure vessel adapted to charge various kinds of pressurized substances, typical examples of which include various kinds of compressed gases such as CNG (compressed natural gas) and various kinds of liquefied gases such as LNG (liquefied natural gas) and LPG (liquefied petroleum gas).

2. Description of Related Art

The pressure vessel adapted to charge various kinds of pressurized substances such as CNG is generally provided with a tubular main body, a metallic mouth ring which is attached to the tubular main body, and a valve which is attached to the metallic mouth ring. In general, an inner peripheral surface of the main body is composed of a liner portion composed of resin, and an outer peripheral surface of the liner portion is composed of a reinforcing portion of a high strength resin (such as FRP, etc.). A flange part is formed around one end of the metallic mouth ring so as to project outwardly. The liner portion covers a bottom surface of the flange part (that is a surface of the flange, which is positioned on an interior side with respect to an axial direction of the main body), and an upper surface of the flange part (that is a surface of the flange, which is positioned on an exterior side with respect to the axial direction of the main body).

In the conventional pressure vessel, one part of the liner portion, which is adapted to cover the bottom surface of the flange part (hereinafter, will be referred to as "flange seal part") has been brought into close contact with the flange part with an internal pressure of a tank. Namely, when the interior of the pressure vessel is charged with a pressurized substance, the flange seal part is pressed on the bottom surface of the flange part with a pressure of the pressurized substance (internal pressure of the tank). Consequently, the flange seal part closely contacts the flange part. However, when the charging amount of the pressurized substance is small (namely, when the internal pressure of the tank is small), there have occurred cases where the flange seal part is not strongly pressed on the bottom surface of the flange part. Therefore, it has been required to improve the sealing properties furthermore. Under these circumstances, there has been proposed the technique of sealing the mouth ring with the liner portion while restraining the variations in the attaching position of the flange seal part relative to the flange part (See publication of unexamined Japanese patent application No. 2004-211783, for example).

As shown in FIG. 6, in the pressure vessel disclosed in the above publication, a control member 500 with high strength is provided outwardly of a flange seal part 510. The control member 500 is composed of a resin material with high strength, such as FRP, and serves to secure the flange seal part 510 in position from the outer peripheral side thereof. Therefore, in accordance with the pressure vessel disclosed in the above-described publication, it has been considered that the attaching position of the flange seal part 510 can be prevented from varying outwardly, and even when the internal pressure of the tank is small, variations in the attaching position of the flange seal part 510 relative to the bottom surface of a flange part 521 can be restrained, whereby a mouth ring 2 is sealed with a liner portion 511.

However, the pressure vessel disclosed in the above-described publication, which requires the control member, has exhibited the problem that the manufacturing person hour increases to raise the manufacturing costs.

SUMMARY OF THE INVENTION

The present invention has been made considering the above-described circumstances, and has an object of providing a pressure vessel capable of securely sealing a mouth ring with a liner portion, and being manufactured at low costs.

A pressure vessel of the present invention capable of solving the above-described problems has a main body which includes a tubular reinforcing portion and a liner portion composed of resin and adapted to cover an inner peripheral surface of the reinforcing portion, a mouth ring which is integrally formed with the main body and adapted to interconnect an interior and an exterior of the main body with each other, and a valve which is inserted in an interior of the mouth ring. The mouth ring includes a cylindrical boss part and a flange part which projects from an outer peripheral surface of the boss part outwardly, the liner portion includes a flange seal part which is integrally formed with the mouth ring to cover a bottom surface of the flange part, and a boss seal part which is formed continuously with the flange seal part to cover at least one part of an inner peripheral surface of the boss part, which extends in the axial direction thereof, the boss seal part includes a boss-side collar part which projects outwardly, and a sealing member composed of a resilient body is disposed in a space between an inner peripheral surface of the boss seal part and an outer peripheral surface of the valve.

It is preferable that the pressure vessel in accordance with the present invention is provided with at least one of the following arrangements (1) through (4).

(1) The flange part has a flange groove which opens on the side of the bottom surface thereof, and the flange seal part has a flange-side collar part adapted to enter the flange groove.

(2) The sealing member is composed of two O rings, and the two O rings are arranged so as to be symmetric in an axial direction of the boss part with respect to the boss-side collar part.

(3) In the case of (2), the distance between axial centers of the two O rings ranges from two through five times as large as the wall thickness of the boss-side collar part.

(4) The boss seal part covers one part of the inner peripheral surface of the boss part, which extends in the axial direction thereof, and a sub-O ring is disposed in a space between the other part of the inner peripheral surface of the boss part, which is not covered with the boss seal part, and the outer peripheral surface of the valve.

In the pressure vessel in accordance with the present invention, the sealing member composed of the resilient body is disposed in the space between the inner peripheral surface of the boss seal part and the outer peripheral surface of the valve. Namely, the pressure vessel in accordance with the present invention secures an end of the liner portion (boss seal part) in position by holding it with the sealing member, the boss part and the valve. Consequently, in the pressure vessel in accordance with the present invention, the attaching position of the liner portion hardly varies relative to the mouth ring. As a result, the pressure vessel of the present invention can securely seal the mouth ring with the liner portion. In addition, the pressure vessel of the present invention does not require such a control member as described above so that the manufacturing person hour can be reduced, and the manufacturing costs can be decreased.

In addition, the boss seal part in the pressure vessel of the present invention has a boss-side collar part so as to be excellent in strength. Therefore, the boss seal part in the pressure vessel of the present invention hardly deforms plastically even when pushed with the sealing member strongly. Consequently, with the pressure vessel of the present invention, the boss seal part can be securely fixed in position with the sealing member, the boss part and the valve. As a result, the pressure vessel of the present invention can seal the mouth ring with the liner portion more securely.

The flange seal part in the pressure vessel of the present invention, which is provided with the above-described arrangement (1), is excellent in strength because of the provision of the flange-side collar part. Therefore, in accordance with the pressure vessel of the present invention, which is provided with the above-described arrangement (1), the mouth ring can be sealed with the liner portion more securely.

In the pressure vessel of the present invention, which is provided with the above-described arrangement (2), the two O rings push the boss seal part on the inner peripheral side of the boss-side collar part uniformly in the axial direction thereof. Consequently, with the pressure vessel of the present invention, which is provided with the above-described arrangement (2), the contact pressure applied with the two O rings (that is the sealing member) can be efficiently received by virtue of the boss-side collar part. Namely, the boss seal part can be efficiently reinforced with the boss-side collar part. As a result, with the pressure vessel of the present invention, which is provided with the above-described arrangement (2), the plastic deformation of the boss seal part can be prevented more securely, and the mouth ring can be sealed with the liner portion more securely.

The pressure vessel in accordance with the present invention, which is provided with the above-described arrangement (3), can seal the mouth ring with the liner portion more securely. This is caused by the following reasons.

In the pressure vessel of the present invention, which is provided with the above-described arrangement (3), the part of the boss seal part, which is apart from the axial center of the boss-side collar part in the axial direction by the distance 2 through 5 times as large as the wall thickness of the boss-side collar part, is reinforced with the boss-side collar part so as to hardly deform particularly. Accordingly, by bringing the two O rings into contact with this part, the plastic deformation of the boss seal part can be prevented more securely. Therefore, the pressure vessel of the present invention, which is provided with the above-described arrangement (3), the mouth ring can be sealed with the liner portion more securely.

The pressure vessel of the present invention, which is provided with the above-described arrangement (4), can seal the space between the valve and the boss part with the sub-O ring. Consequently, even when the boss seal part greatly deforms plastically, and the space between the valve and the boss part cannot be sufficiently sealed with the boss seal part and the O ring, the sub-O ring seals the space between the valve and the boss part. Therefore, the pressurized substance charged in the interior of the pressure vessel is prevented from leaking out via the space between the valve and the boss part.

Other objects, features, and characteristics of the present invention will become apparent upon consideration of the following description and the appended claims with reference to the accompanying drawings, all of which form a part of this specification.

DETAILED DESCRIPTION OF THE PREFERRED EMBODIMENTS

Hereinafter, the pressure vessel in accordance with the present invention will be explained with reference to the drawings.

Embodiment 1

Figure 1:
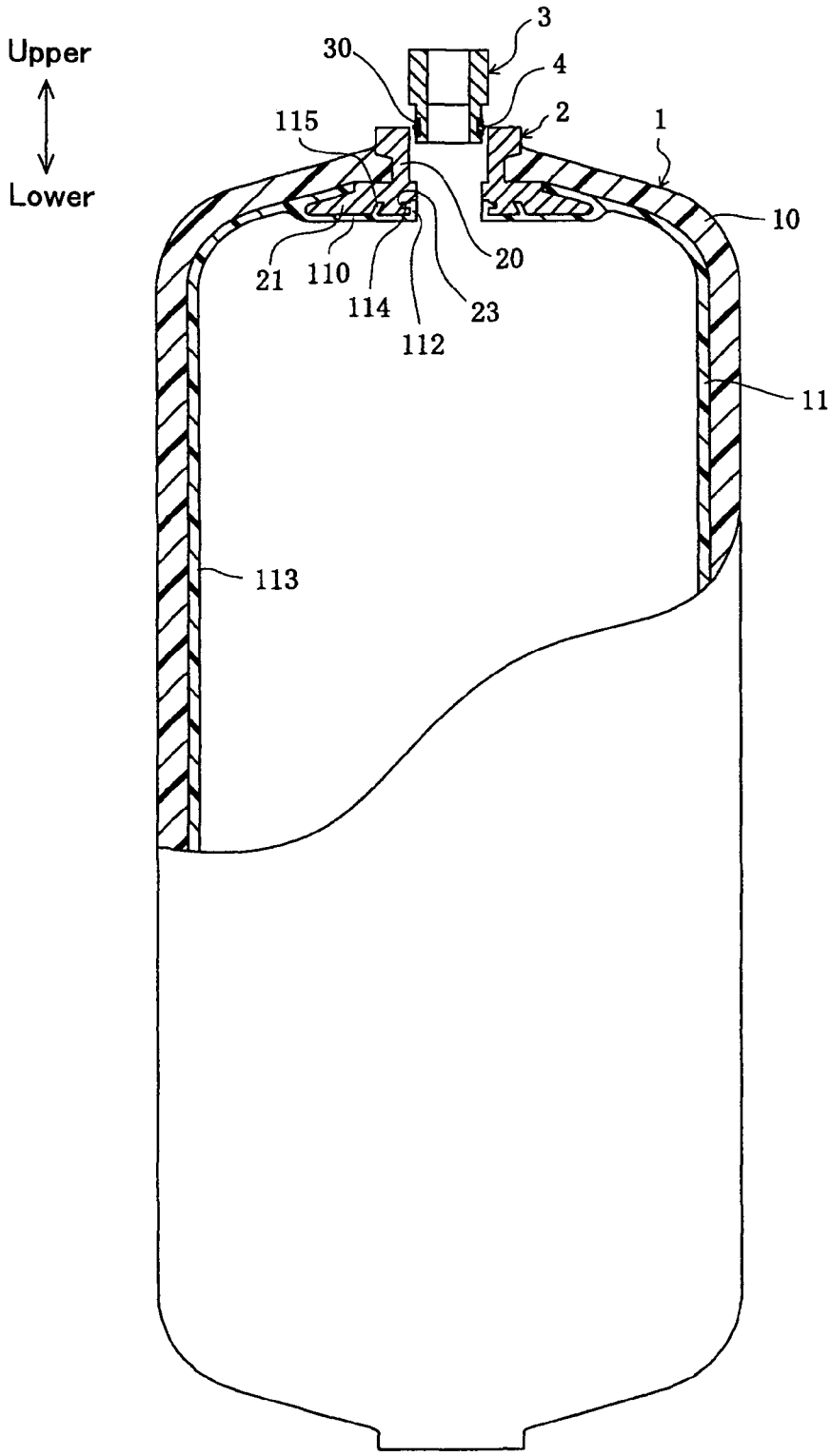
FIG. 1 is a partially cut-away exploded diagram which schematically shows a pressure vessel of Embodiment 1.
Figure 2:
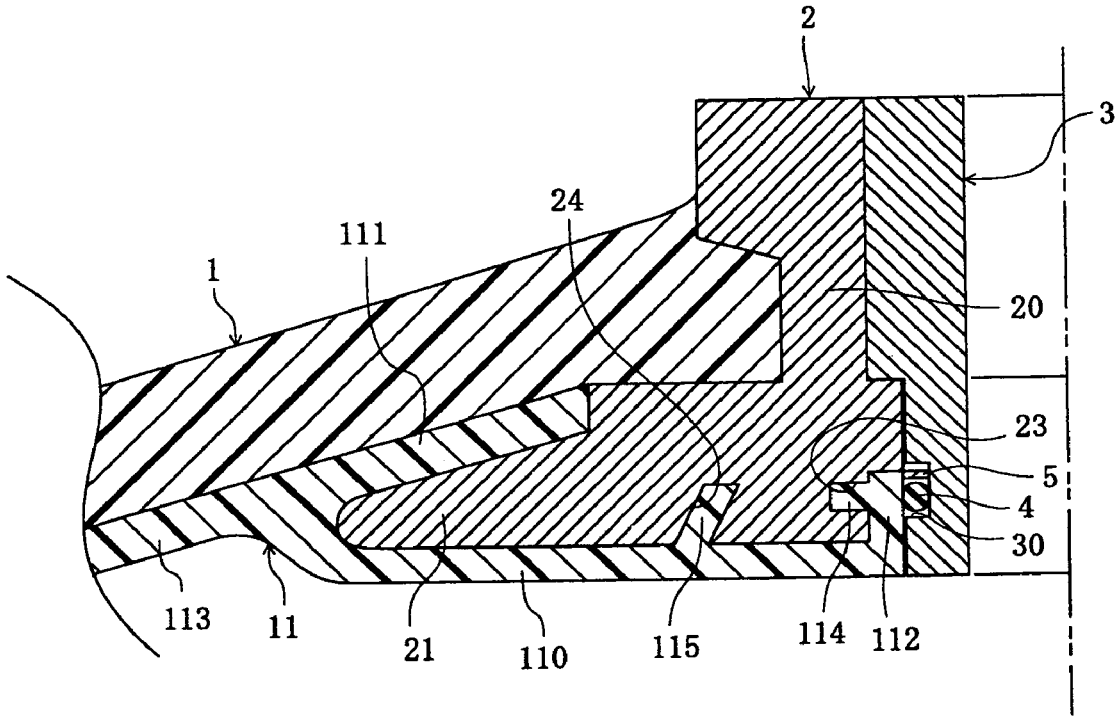
FIG. 2 is an enlarged sectional view of a main part of a pressure vessel of Embodiment 1, which schematically shows the state cut in an axial direction thereof.

The pressure vessel of Embodiment 1 is a fuel tank for use in a motor vehicle, and is provided with the above-described arrangement (1). FIG. 1 is a partially cut-away exploded view which schematically shows the pressure vessel of Embodiment 1. FIG. 2 is an enlarged sectional view of a main part of a pressure vessel of Embodiment 1, which schematically shows the state cut in an axial direction thereof. Hereinafter, in Embodiment 1, the terms "upper" and "lower" denote "upper" and "lower" in FIG. 1.

The pressure vessel of Embodiment 1 is provided with a main body 1, a mouth ring 2 and a valve 3.

The main body 1 has a cylindrical (tubular) configuration of which two ends positioned in an axial direction thereof (upward and downward in FIG. 1) have reduced diameters. The main body 1 has a reinforcing portion 10 and a liner portion 11. The liner portion 11 is composed of EVOH (ethylene-vinyl alcohol copolymer resin) which is excellent in gas barrier properties. The reinforcing portion 10 is composed of FRP which contains carbon fiber and epoxy resin, and is formed around an outer periphery of the liner portion 11. Namely, the liner portion 11 covers an inner peripheral surface of the reinforcing portion 10. One opening (lower opening in FIG. 1) of the main body 1 is sealed with a plug member (not shown). The mouth ring 2 composed of metal is secured to the other opening (upper opening in FIG. 1).

The mouth ring 2 has a boss part 20 and a flange part 21. The boss part 20 has a cylindrical configuration. Thread grooves (not shown) are formed in the inner peripheral surface of the boss part 20 on the exterior side of the main body 1 in the axial direction thereof (upper side in FIG. 1, hereinafter will be referred to as "exterior side in the axial direction"). As shown in FIG. 2, a boss groove 23 is formed in the inner peripheral surface of the boss part 20 on the interior side of the main body 1 in the axial direction (lower side in FIG. 1, hereinafter will be referred to as "interior side in the axial direction"). The boss groove 23 has an annular configuration which is recessed toward the outer periphery of the boss part 20, and opens on the side of the inner peripheral surface of the boss part 20. The flange part 21 projects outwardly from an outer peripheral surface of the boss part 20 on the interior side in the axial direction. In the pressure vessel of Embodiment 1, the flange part 21 has an annular configuration which continues from the entire circumference of the outer periphery of the boss part 20. An annular flange groove 24 is formed in the flange part 21 so as to be recessed in an axial direction thereof. The flange groove 24 opens on the side of the bottom surface of the flange part 21 (a surface of the flange part 21, which is positioned on the interior side in the axial direction, that is a lower surface in FIG. 1).

The liner portion 11 is formed integrally with the mouth ring 2. The liner portion 11 has a flange seal part 110, a flange sub-seal part 111, a boss seal part 112 and a remaining part 113. The flange seal part 110 covers the bottom surface of the flange part 21. The flange sub-seal part 111 covers one part of an upper surface of the flange part 21 (a surface of the flange part 21, which is positioned on the exterior side in the axial direction, that is an upper surface in FIG. 1). The boss seal part 112 covers the inner peripheral surface of the boss part 20 on the interior side in the axial direction.

A boss-side collar part 114 as one part of the boss seal part 112 enters an interior of the boss groove 23. The boss-side collar part 114 has an annular configuration. A flange-side collar part 115 as one part of the flange seal part 110 enters an interior of the flange groove 24. The flange-side collar part 115 has an annular configuration.

The valve 3 is composed of metal. Thread grooves (not shown) are formed in the outer peripheral surface of the valve 3 on the exterior side in the axial direction (upper part in FIG. 1). The thread grooves of the valve 3 have configurations complementary to those of the above-described thread grooves of the boss part 20, and the valve 3 is screwed with the boss part 20 to be attached to the mouth ring 2.

An annular O ring holding groove 30 is formed in the outer peripheral surface of the valve 3 on the interior side in the axial direction (lower part in FIG. 1), so as to be recessed inwardly of the valve 3. An O ring 4 and a backup ring 5 are held in the O ring holding groove 30. The O ring 4 is composed of a resilient material. The backup ring 5 is composed of a hard resin material. The backup ring 5 is arranged on the exterior side in the axial direction of the O ring 4 (upper side in FIG. 1) to limit the movement of the O ring 4 in the axial direction. The outside diameter of the backup ring 5 is smaller than that of the O ring 4.

The O ring 4 corresponds to the sealing member in the pressure vessel in accordance with the present invention. When the valve 3 is attached to the mouth ring 2, an inner peripheral surface of the O ring 4 contacts and pushes the outer peripheral surface of the valve 3, and an outer peripheral surface of the O ring 4 contacts and pushes the inner peripheral surface of the boss seal part 112. As a result, the O ring 4 seals a space between the valve 3 and the boss seal part 112. And, the boss seal part 112 is held with the valve 3 and the boss part 20 via the O ring 4. Namely, the boss seal part 112 is secured with the O ring 4, the boss part 20 and the valve 3 in position. In the pressure vessel of Embodiment 1, the axial center of the boss-side collar part 114 approximately coincides with that of the O ring 4.

In the pressure vessel of Embodiment 1, the boss seal part 112 is secured with the O ring 4, the boss part 20 and the valve 3 in position. Therefore, with the pressure vessel of Embodiment 1, even when the internal pressure of the tank is low, the attaching position of the boss seal part 112 does not vary relative to the boss part 20 so that the attaching position of the flange seal part 110 does not vary relative to the flange part 21. Consequently, the liner portion 11 in the pressure vessel of Embodiment 1 seals the mouth ring 2 securely.

In addition, since the boss-side collar part 114 has an annular configuration, it exhibits excellent strength. Consequently, the boss seal part 112 is reinforced with the boss-side collar part 114. And since the axial center of the boss-side collar part 114 approximately coincides with that of the O ring 4, the boss-side collar part 114 can efficiently reinforce the boss seal part 112 in the part which is securely pushed with the O ring 4 (to which a large contact pressure is applied). Consequently, the boss seal part 112 in the pressure vessel of Embodiment 1 hardly deforms plastically even when pushed with the O ring 4. Therefore, with the pressure vessel of Embodiment 1, the contact pressure of the boss seal part 112 and the O ring 4 can be made sufficiently great so that the boss seal part 112 can be strongly secured with the O ring 4, the boss part 20 and the valve 3 in position. As a result, the liner portion 11 in the pressure vessel of Embodiment 1 can seal the mouth ring 2 securely.

Furthermore, the flange-side collar part 115 has an annular configuration so as to be excellent in strength. Therefore, the flange seal part 110 in the pressure vessel of Embodiment 1 is reinforced with the flange-side collar part 115 so as to hardly deform. Consequently, in the pressure vessel of Embodiment 1, the flange seal part 110 hardly deforms or enlarges in diameter even when the internal pressure of the tank rises and the liner portion 11 expands. Therefore, in the pressure vessel of Embodiment 1, the flange seal part 110 is prevented from peeling from the flange part 21, and the boss seal part 112 is prevented from peeling from the boss part 20 due to the deformation of the flange seal part 110 even when the internal pressure of the tank is high. As a result, the liner portion 11 in the pressure vessel of Embodiment 1 can seal the mouth ring 2 more securely.

The liner portion 11 in the pressure vessel of Embodiment 1 is composed of EVOH, but the material of the liner portion 11 in the pressure vessel in accordance with the present invention may be arbitrarily selected depending on the pressurized substance to be charged therein. For example, PPS (polyphenylene sulfide), polyethylene, nylon, etc. are preferably used as the material of the liner portion 11.

The reinforcing portion 10 in the pressure vessel of Embodiment 1 is composed of FRP containing carbon fiber and epoxy resin, but may be composed of glass fiber, aramid fiber, etc. instead of carbon fiber.

The boss seal part 112 in the pressure vessel of Embodiment 1 covers the inner peripheral surface of the boss part 20 in one part extending in an axial direction, but the boss seal part 112 in the pressure vessel in accordance with the present invention may cover the entire inner peripheral surface of the boss part 20. In this case, by covering the inner peripheral surface of the boss part 20 with the boss seal part 112, and disposing the sealing member in the space between the inner peripheral surface of the boss seal part 112 and the outer peripheral surface of the valve 3, the sealing member, the boss part 20 and the valve 3 can strongly secure the flange seal part 110 in position, and consequently, the mouth ring 2 can be securely sealed with the liner portion 11.

The boss-side collar part 114 in the pressure vessel of Embodiment 1 has an annular configuration, but the boss-side collar part 114 in the pressure vessel in accordance with the present invention may have other configuration (such as C-shaped configuration) than the annular configuration. Namely, the boss-side collar part 114 in the pressure vessel of Embodiment 1 is formed over the entire circumference of the outer periphery of the boss part 20, but the boss-side collar part 114 in the pressure vessel in accordance with the present invention may be formed only in one part of the outer periphery of the boss part 20. The annular boss-side collar part 114 is excellent in strength, particularly, but the boss-side collar part 114 with other configuration than the annular configuration can sufficiently reinforce the boss seal part 112 by properly determining the pushing force of the sealing member.

In addition, the flange seal part 110 in the pressure vessel of Embodiment 1 is provided with the flange-side collar part 115, but the flange seal part 110 in the pressure vessel in accordance with the present invention may not be provided with the flange-side collar part 115. And, the flange-side collar part 115 in the pressure vessel in accordance with the present invention may be formed to have other configuration (such as C-shaped, etc.) than the annular configuration.

Embodiment 2

Figure 3:
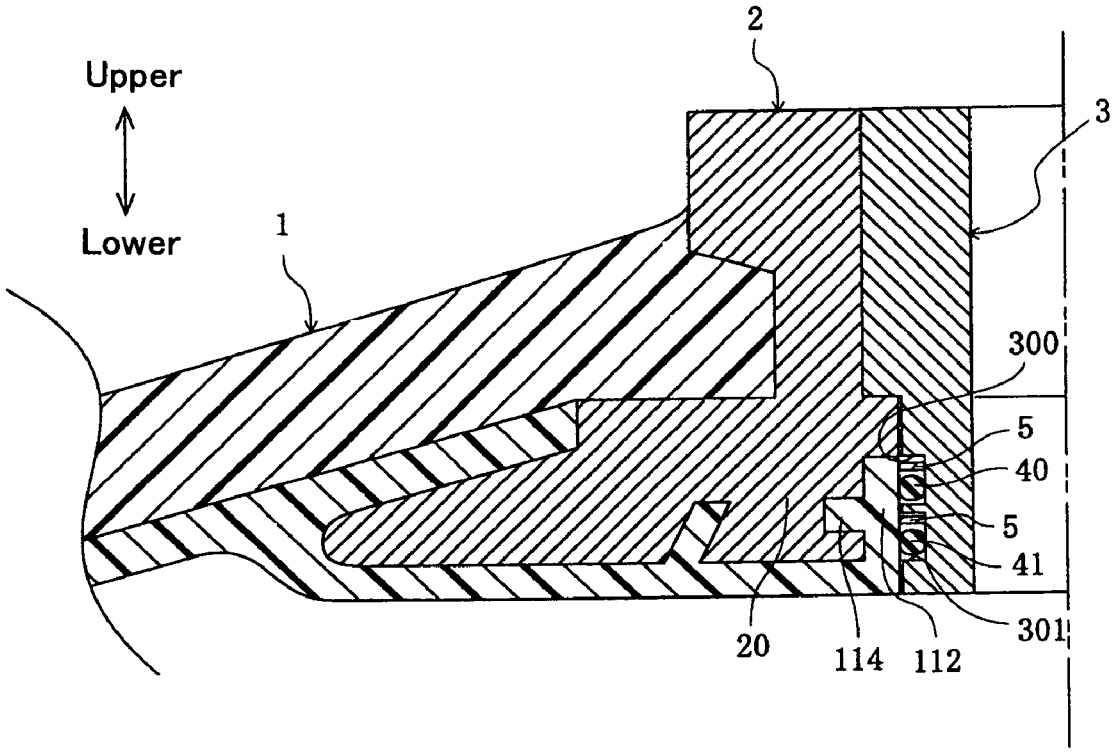
FIG. 3 is an enlarged sectional view of a main part of a pressure vessel of Embodiment 2, which schematically shows the state cut in an axial direction thereof.
Figure 4:
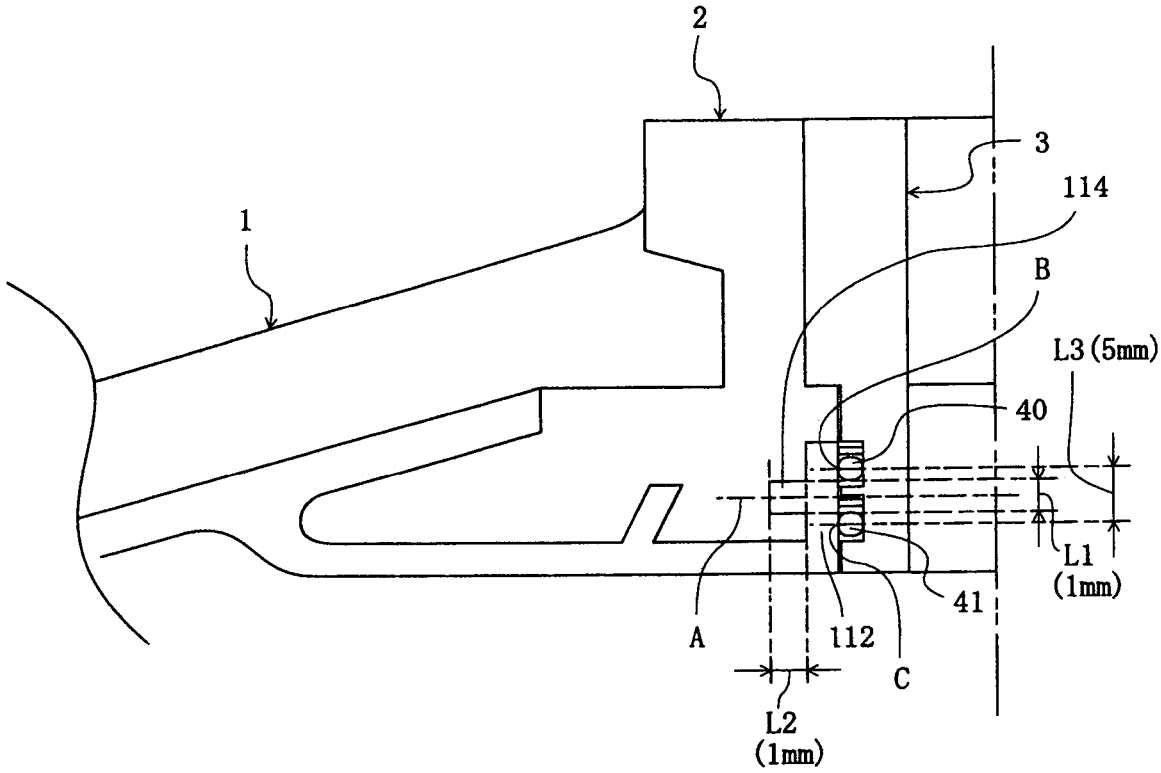
FIG. 4 is a diagram which schematically shows a pressure vessel of Embodiment 2.

The pressure vessel of Embodiment 2 is provided with the above-described arrangements (1) through (3). The pressure vessel of Embodiment 2 is identical to that of Embodiment 1 except that the sealing member is composed of two O rings, and the valve has two grooves for holding the O rings. FIG. 3 is an enlarged sectional view of a main part of the pressure vessel, which schematically shows the state where the pressure vessel is cut in the axial direction thereof. FIG. 4 is an explanation view which schematically shows the pressure vessel of Embodiment 2. Hereinafter, in Embodiment 2, the terms "upper" and "lower" denote "upper" and "lower" in FIG. 3.

As shown in FIGS. 3 and 4, the pressure vessel of Embodiment 2 has two O rings (first O ring 40, second O ring 41). These O rings 40, 41 correspond to the sealing member in the pressure vessel in accordance with the present invention. Two O ring holding grooves (300, 301) are formed in the valve 3. The O ring holding groove 300 is formed on the exterior side (upper side in FIG. 3) of the O ring holding groove 301 in the axial direction. The O ring holding groove 300 holds the first O ring 40 and a backup ring 5. The other O ring holding groove 301 holds the second O ring 41 and a backup ring 5. Therefore, the first O ring 40 is held on the exterior side of the second O ring 41 in the axial direction.

When the valve 3 is attached to the boss part 20 of the mouth ring 2, an inner peripheral surface of the first O ring 40 and an inner peripheral surface of the second O ring 41 contact and push the outer peripheral surface of the valve 3. And an outer peripheral surface of the first O ring 40 and an outer peripheral surface of the second O ring 41 contact and push the inner peripheral surface of the boss seal part 112. Therefore, the first O ring 40 and the second O ring 41 seal a space between the valve 3 and the boss seal part 112. And the boss seal part 112 is secured with the first O ring 40, the second O ring 41, the boss part 20 and the valve 3 in position. In the pressure vessel of Embodiment 2, the first O ring 40 and the second O ring 41 are arranged so as to be symmetric in the axial direction with respect to the boss-side collar part 114.

As shown in FIG. 4, the boss-side collar part 114 has a wall thickness L1 of 1 mm, and a projecting height (radial length) of 1 mm. The axial center of the first O ring 40 is spaced apart from the axial center of the second O ring 41 by the distance L3 of 5 mm.

In the pressure vessel of Embodiment 2, the boss seal part 112 is secured with the O rings 40, 41, the boss part 20 and the valve 3 in position. Consequently, the liner portion 11 in the pressure vessel of Embodiment 2 seals the mouth ring 2 securely.

And, the boss seal part 112 is reinforced with the boss-side collar part 114. Consequently, the boss seal part 112 hardly deforms plastically even when pushed with the first O ring 40 and the second O ring 41. In addition, the first O ring 40 and the second O ring 41 are arranged so as to be symmetric in the axial direction with respect to the boss-side collar part 114. As a result, the first O ring 40 and the second O ring 41 uniformly push the boss seal part 112 in its inner peripheral surface facing the boss-side collar part 114. Therefore, with the pressure vessel of Embodiment 2, the boss seal part 112 can be efficiently reinforced with the boss-side collar part 114. In the boss seal part 112 in the pressure vessel of embodiment 2, parts (B, C) which are respectively spaced by 2.5 mm apart from an axial center A of the boss-side collar part 114 in the axial direction hardly deform, particularly. In the pressure vessel of Embodiment 2, since these parts which hardly deform particularly are pushed with the first O ring 40 and the second O ring 41, the plastic deformation of the boss seal part 112 is prevented more securely. Therefore, the liner portion 11 in the pressure vessel of Embodiment 2 can seal the mouth ring 2 more securely.

Furthermore, the flange-side collar part 115 in the pressure vessel of Embodiment 2 has an annular configuration so that the flange seal part 110 in the pressure vessel of Embodiment 2 is reinforced with the flange-side collar part 115 so as to hardly deform. Consequently, with the pressure vessel of Embodiment 2, the flange seal part 110 hardly deforms or enlarges in diameter, and accordingly, the liner portion 11 can seal the mouth ring 2 securely.

Embodiment 3

Figure 5:
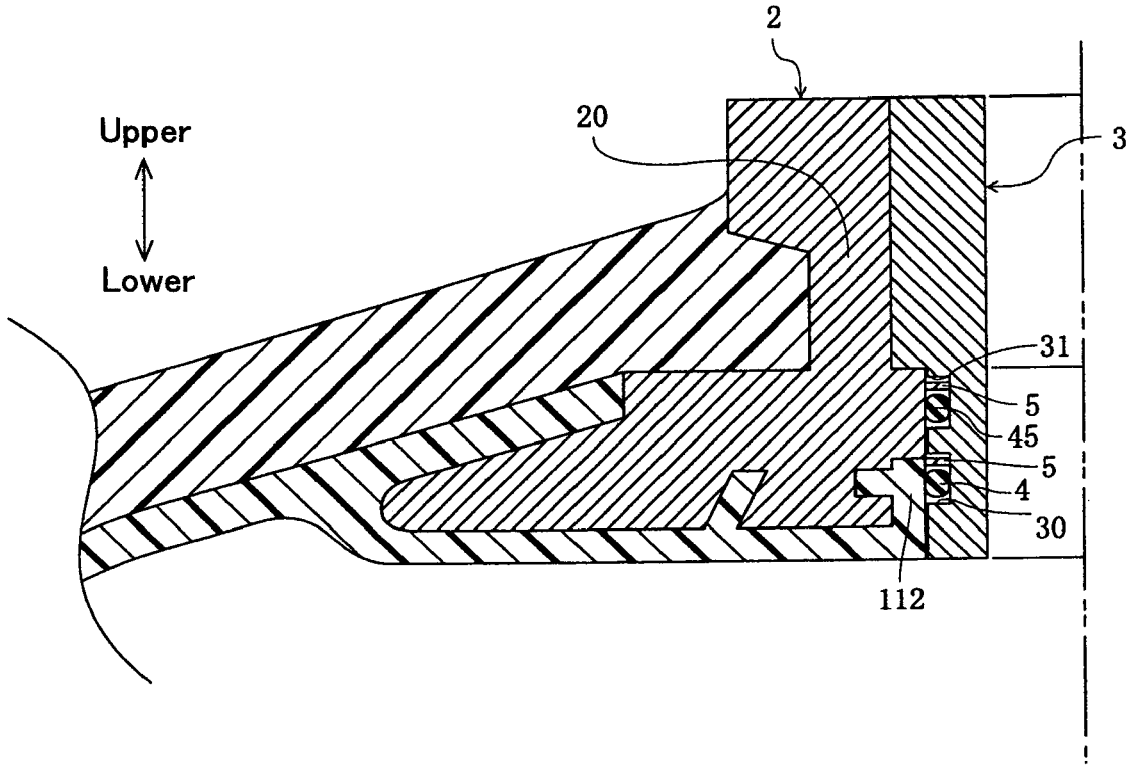
FIG. 5 is an enlarged sectional view of a main part of a pressure vessel of Embodiment 3, which schematically shows the state cut in an axial direction thereof.
Figure 6:
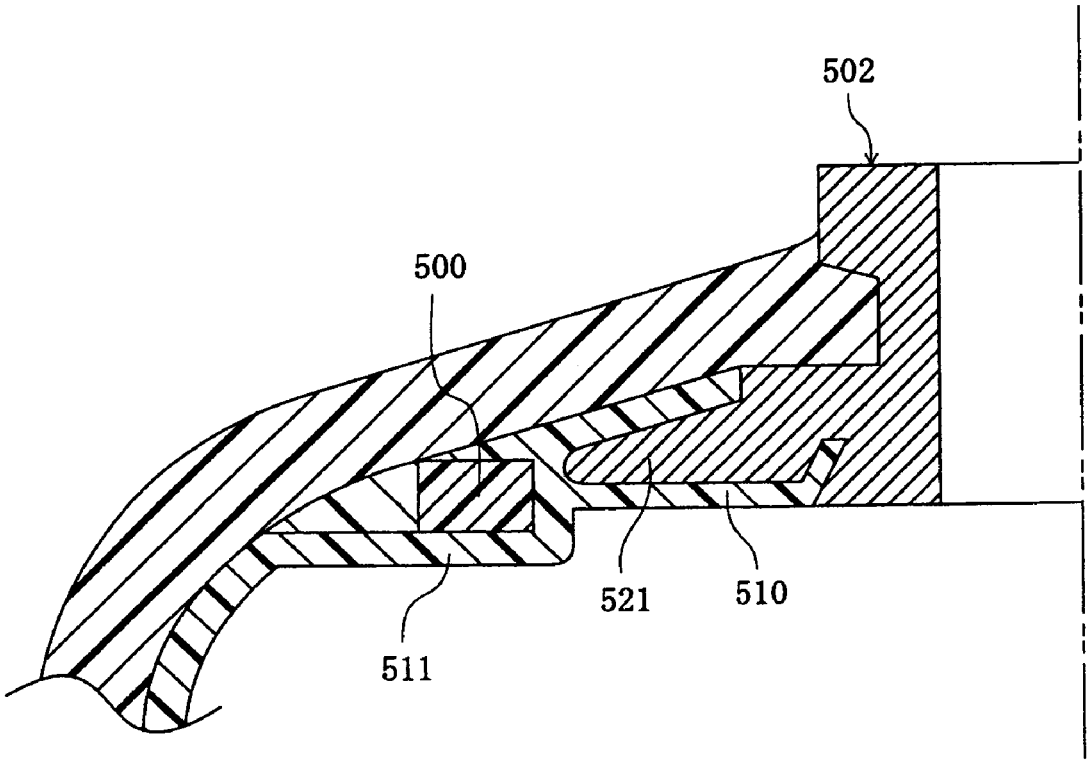
FIG. 6 is an enlarged sectional view of a main part of a conventional pressure vessel, which schematically shows the state cut in an axial direction thereof.

The pressure vessel of Embodiment 3 is provided with the above-described arrangements (1) and (4). The pressure vessel of Embodiment 3 is identical to that of Embodiment 1 except that the sub-sealing member is provided therein. FIG. 5 is an enlarged sectional view of a main part of the pressure vessel, which schematically shows the state where the pressure vessel is cut in the axial direction thereof. Hereinafter, in Embodiment 3, the terms "upper" and "lower" denote "upper" and "lower" in FIG. 5.

The boss seal part 112 in the pressure vessel of Embodiment 3 covers only the part of the inner peripheral surface of the boss part 20 on the interior side in the axial direction (lower part in FIG. 5). Consequently, the part of the inner peripheral surface of the boss part 20 on the exterior side in the axial direction is exposed to external view.

An annular first O ring holding groove 30 is formed in the part of the outer peripheral surface of the valve 3 on the interior side in the axial direction so as to be recessed inwardly of the valve 3. An O ring (a main O ring 4) and a backup ring 5 are held in the first O ring holding groove 30. The main O ring 4 corresponds to the sealing member in the pressure vessel in accordance with the present invention. An annular second O ring holding groove 31 is formed in the part of the outer peripheral surface of the valve 3 on the approximately central part in the axial direction so as to be recessed inwardly of the valve 3. An O ring (a sub-O ring 45) and a backup ring 5 are held in the second O ring holding groove 31. The sub-O ring 45 corresponds to the sub-sealing member in the pressure vessel in accordance with the present invention.

When the valve 3 is attached to the boss part 20 of the mouth ring 2, the inner peripheral surface of the main O ring 4 contacts and pushes the outer peripheral surface of the valve 3, and the outer peripheral surface of the main O ring 4 contacts and pushes the inner peripheral surface of the boss seal part 112. Therefore, the main O ring 4 seals a space between the valve 3 and the boss seal part 112, and the boss seal part 112 is secured with the main O ring 4, the valve 3 and the boss part 20 in position. And, when the valve 3 is attached to the boss part 20 of the mouth ring 2, the inner peripheral surface of the sub-O ring 45 contacts and pushes the outer peripheral surface of the valve 3, and the outer peripheral surface of the sub-O ring 45 contacts and pushes the inner peripheral surface of the boss part 20. Therefore, the sub-O ring 45 seals a space between the valve 3 and the boss part 20 on the exterior side of the main O ring 4. Consequently, with the pressure vessel in accordance with Embodiment 2, even when the boss seal part 112 greatly deforms plastically so that the boss seal part 112 and the main O ring 4 cannot sufficiently seal the space between the valve 3 and the boss part 20, the sub-O ring 45 seals the space between the valve 3 and the boss part 20. Therefore, with the pressure vessel of Embodiment 3, the pressurized substance charged in the interior of the pressure vessel is prevented from leaking out via the space between the valve 3 and the boss part 20.

In the pressure vessel of Embodiment 3, since the boss seal part 112 is secured with the main O ring 4, the valve 3 and the boss part 20 in position so that the liner portion 11 securely seals the mouth ring 2.

In addition, in the pressure vessel of Embodiment 3, the boss seal part 112 is reinforced with the boss-side collar part 114 so as to hardly deform plastically even when pushed with the main O ring 4. Consequently, the pressure vessel of Embodiment 3 can hold the boss seal part 112 with the main O ring 4, the valve 3 and the boss part 20 securely. Therefore, the liner portion 11 in the pressure vessel of Embodiment 3 seals the mouth ring 2 more securely.

In addition, the flange seal part 110 in the pressure vessel of Embodiment 3 is reinforced with the flange-side collar part 115 so as to hardly deform or enlarge in diameter. Consequently, with the pressure vessel of Embodiment 3, the liner portion 11 can seal the mouth ring 2 securely.

While the invention has been described in connection with what are considered to be the preferred embodiments, it is to be understood that the invention is not limited to the disclosed embodiments, but, on the contrary, is intended to cover various modifications and equivalent arrangements included within the spirit and scope of the appended claims.

What is claimed is:

1. A pressure vessel comprising:

a main body including a reinforcing portion which has a tubular configuration, and a liner portion which is composed of resin and covers an inner peripheral surface of the reinforcing portion;

a mouth ring integrally formed with the main body to interconnect an interior and an exterior of the main body with each other; and a valve to be inserted in the mouth ring on an inner peripheral side thereof, wherein:

the mouth ring includes a cylindrical boss part, and a flange part which projects outwardly from an outer peripheral surface of the boss part;

the liner portion is integrally formed with the mouth ring and includes a flange seal part which covers a bottom surface of the flange part, and a boss seal part which is formed continuously with the flange seal part to cover at least one part of an inner peripheral surface of the boss part in the axial direction thereof, the boss seal part including a boss-side collar part which projects outwardly, and a sealing member composed of a resilient body being disposed in a space between an inner peripheral surface of the boss seal part and an outer peripheral surface of the valve;

the flange part has a flange groove which opens on the side of the bottom surface of the flange part, and the flange seal part has a flange-side collar part which enters the flange groove;

the boss seal part covers the inner peripheral surface of the boss part in one part which extends in the axial direction thereof, and a ring-shaped sub-sealing member is disposed in a space between the other part of the inner peripheral surface of the boss part, which is not covered with the boss seal part, and the outer peripheral surface of the valve;

the boss part has a boss groove that opens on the side of the inner peripheral surface of the boss part; and the boss seal part enters an interior of the boss groove.

2. A pressure vessel comprising:

a main body including a reinforcing portion which has a tubular configuration, and a liner portion which is composed of resin and covers an inner peripheral surface of the reinforcing portion;

a mouth ring integrally formed with the main body to interconnect an interior and an exterior of the main body with each other; and a valve to be inserted in the mouth ring on an inner peripheral side thereof, wherein;

the mouth ring includes a cylindrical boss part, and a flange part which projects outwardly from an outer peripheral surface of the boss part;

the liner portion is integrally formed with the mouth ring and includes a flange seal part which covers a bottom surface of the flange part, and a boss seal part which is formed continuously with the flange seal part to cover at least one part of an inner peripheral surface of the boss part in the axial direction thereof, the boss seal part including a boss-side collar part which projects outwardly, and a sealing member composed of a resilient body being disposed in a space between an inner peripheral surface of the boss seal part and an outer peripheral surface of the valve; and the sealing member includes two O rings, and the two O rings are arranged to be symmetric in an axial direction of the boss part with respect to the boss-side collar part.

3. A pressure vessel as claimed in claim 2, wherein the two O rings are spaced apart from each other such that a distance between axial centers of the two O rings ranges from two through five times as large as the wall thickness of the boss-side collar part.

4. A pressure vessel as claimed in claim 1, wherein the flange-side collar part and the boss seal part prevent movement of the flange seal part in a radial direction.

* * * * *